US008919145B2

(12) United States Patent
Bortoletto et al.

(10) Patent No.: US 8,919,145 B2
(45) Date of Patent: Dec. 30, 2014

(54) VERTICAL ICE MAKER WITH MICROCHANNEL EVAPORATOR

(75) Inventors: Anderson Bortoletto, Waunakee, WI (US); Nihat Cur, Saint Joseph, MI (US); Douglas D. Leclear, Benton Harbor, MI (US); Andrew M. Tenbarge, Saint Joseph, MI (US); Ronald L. Voglewede, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 457 days.

(21) Appl. No.: 13/166,068

(22) Filed: Jun. 22, 2011

(65) Prior Publication Data

US 2012/0324917 A1 Dec. 27, 2012

(51) Int. Cl.

| | |
|---|---|
| ***F25C 5/18*** | (2006.01) |
| ***F25C 1/00*** | (2006.01) |
| ***F25C 1/12*** | (2006.01) |
| ***F25C 5/08*** | (2006.01) |
| ***F25C 1/18*** | (2006.01) |

(52) U.S. Cl.

CPC ..... *F25C 1/12* (2013.01); *F25C 2400/10* (2013.01); *F25C 5/08* (2013.01); *F25C 1/18* (2013.01)

USPC ..... 62/344; 62/347; 62/348

(58) Field of Classification Search

USPC ..... 62/344, 347, 348

See application file for complete search history.

(56) References Cited

U.S. PATENT DOCUMENTS

| | | | | |
|---|---|---|---|---|
| 1,825,698 A | | 10/1931 | King | |
| 2,349,367 A | | 5/1944 | Muffly | |
| 3,380,261 A | | 4/1968 | Hendrix et al. | |
| 3,418,823 A | | 12/1968 | Vivai | |
| 3,433,030 A | | 3/1969 | Jacobs | |
| 3,526,100 A | | 9/1970 | Briel | |
| 3,657,899 A | * | 4/1972 | Hosoda et al. | 62/137 |
| 4,184,339 A | | 1/1980 | Wessa | |
| 4,199,956 A | | 4/1980 | Lunde | |
| 4,207,750 A | | 6/1980 | Simkens | |
| 4,341,087 A | * | 7/1982 | Van Steenburgh, Jr. | 62/233 |
| 4,580,410 A | * | 4/1986 | Toya | 62/347 |
| 4,688,386 A | * | 8/1987 | Lane et al. | 62/72 |
| 4,869,067 A | * | 9/1989 | Sears | 60/645 |
| 4,896,800 A | | 1/1990 | Corey | |
| 5,032,157 A | | 7/1991 | Ruff | |
| 5,187,948 A | | 2/1993 | Frohbieter | |

(Continued)

FOREIGN PATENT DOCUMENTS

| | | |
|---|---|---|
| EP | 0227611 A1 | 7/1987 |
| EP | 0580950 A1 | 2/1994 |

(Continued)

*Primary Examiner* — Frantz Jules
*Assistant Examiner* — Steve Tanenbaum

(57) ABSTRACT

A clear ice making assembly and method utilizes a housing having an upper fluid chamber, a plurality of distinct, substantially vertical fluid channels, and at least one fluid outlet aperture in fluid communication with a bottom fluid chamber. During an ice making event, portions of an ice forming evaporator extending through the housing are exposed to water flowing into the fluid channels from the upper fluid chamber. The ice forming evaporator is formed with microchannels through which refrigerant flows such that water flowing across the fluid channels freezes on the exposed portions of the ice forming evaporator over time, forming clear ice pieces. In a harvesting operation, the ice pieces are released from the ice forming evaporator and transferred for storage and/or dispensing.

21 Claims, 5 Drawing Sheets

(56) References Cited

U.S. PATENT DOCUMENTS

| | | | | |
|---|---|---|---|---|
| 5,207,761 | A | 5/1993 | Ruff | |
| 5,212,957 | A * | 5/1993 | Ruff | 62/124 |
| 5,272,884 | A | 12/1993 | Cur et al. | |
| 5,297,394 | A | 3/1994 | Frohbieter et al. | |
| 5,375,432 | A | 12/1994 | Cur | |
| 5,425,243 | A | 6/1995 | Sanuki et al. | |
| 5,987,900 | A | 11/1999 | Love | |
| 6,000,228 | A * | 12/1999 | Johnson et al. | 62/73 |
| 6,324,863 | B1 * | 12/2001 | Henry | 62/347 |
| 6,508,075 | B1 * | 1/2003 | Shipley et al. | 62/347 |
| 6,647,739 | B1 | 11/2003 | Kim et al. | |
| 6,688,130 | B1 | 2/2004 | Kim | |
| 6,688,131 | B1 | 2/2004 | Kim et al. | |
| 6,742,351 | B2 | 6/2004 | Kim et al. | |
| 6,907,744 | B2 | 6/2005 | Miller et al. | |
| 6,952,937 | B2 * | 10/2005 | Choi et al. | 62/347 |
| 7,032,406 | B2 * | 4/2006 | Hollen et al. | 62/347 |
| 7,062,936 | B2 | 6/2006 | Rand et al. | |
| 7,082,782 | B2 | 8/2006 | Schlosser et al. | |
| 7,201,015 | B2 * | 4/2007 | Feldman et al. | 62/347 |
| 7,437,885 | B2 * | 10/2008 | Wu et al. | 62/344 |
| 7,587,905 | B2 | 9/2009 | Kopf | |
| 7,703,299 | B2 * | 4/2010 | Schlosser et al. | 62/347 |
| 7,841,198 | B2 * | 11/2010 | Bippus et al. | 62/233 |
| 2004/0255606 | A1 | 12/2004 | Hornung | |
| 2006/0130517 | A1 * | 6/2006 | Merkys et al. | 62/515 |
| 2009/0260371 | A1 | 10/2009 | Kuehl et al. | |
| 2009/0293508 | A1 | 12/2009 | Rafalovich et al. | |
| 2011/0042047 | A1 * | 2/2011 | Karl et al. | 165/115 |

FOREIGN PATENT DOCUMENTS

| | | | |
|---|---|---|---|
| EP | 0580952 | A1 | 2/1994 |
| EP | 0736738 | A2 | 10/1996 |
| GB | 2189016 | A | 10/1987 |

* cited by examiner

VERTICAL ICE MAKER WITH MICROCHANNEL EVAPORATOR

BACKGROUND OF THE INVENTION

1. Field of the Invention

The present invention pertains to the art of refrigerators and, more particularly, to ice makers for producing clear ice pieces.

2. Description of the Related Art

In general, ice pieces produced with standard ice makers tend to include air bubbles or other imperfections that lend a cloudy or impure appearance to the ice. Therefore, there has been an interest in constructing ice makers which produce clear ice pieces. One approach to preventing the formation of cloudy ice is to agitate or move water in an ice tray during the freezing process. For example, U.S. Pat. No. 4,199,956 teaches an ice making method wherein a plurality of freezing elements are immersed in a pan of water which is agitated by a plurality of paddles during a freezing process. This type of ice maker requires water to be added to the pan every new freezing cycle, and may lead to minerals or other impurities concentrating or collecting in the pan over time. Another approach utilizes the continuous flow of water over a vertical ice-forming plate in a refrigerator compartment to produce ice having a higher purity then that of the original tap water. Specifically, multiple spaced points located on the vertical ice-forming plate are in contact with an evaporator line such that water flowing over the spaced points freezes in layers over time, gradually forming a plurality of ice pieces. In order to harvest the ice pieces, hot refrigerant gas flows into the evaporator line, the warming effect detaches the ice pieces from the ice-forming plate, and the ice pieces fall into an ice bin within the refrigerator compartment. However, large spaces must be left between the contact points of the evaporator in order to prevent ice bridges from developing between ice pieces, thus requiring either relatively large quantities of water to flow over the multiple spaced points, or fewer spaced points. Additionally, this system utilizes the refrigerator's own evaporator, thus requiring specific structure in both the refrigerator and ice maker system. Further, ice pieces collected in the ice bin melt over time, which results in diminished ice quality.

Therefore, there is seen to be a need in the art for improved ice makers for domestic refrigerators that can be utilized with various refrigerator configurations and produce high quality clear ice pieces utilizing minimal amounts of water.

SUMMARY OF THE INVENTION

The present invention is directed to a clear ice making assembly and method for a refrigerator which utilizes a vertical ice maker. A housing of the ice maker defines an upper fluid chamber which supplies fluid to a plurality of distinct, substantially vertical, fluid channels each of which is exposed to a portion of an ice forming evaporator enclosed within the housing. Cooled refrigerant flows through microchannels in the ice forming evaporator, thereby cooling the ice forming evaporator. During an ice making cycle, fluid is continuously supplied to the upper fluid chamber, resulting in streams or sheets of fluid flowing through each of the substantially vertical fluid channels and cascading over the exposed portions of the ice forming evaporator therein. Fluid contacting the exposed portions freezes in thin layers over time to form clear ice pieces based on the shape of the exposed portion of the ice forming evaporator. The remaining cascades of fluid drain through fluid outlet apertures defined by the housing, and into a bottom fluid chamber. A pump is utilized to recirculate fluid from the bottom fluid chamber to the upper fluid chamber.

During an ice harvesting cycle, the ice forming evaporator is heated to release ice pieces formed within the vertical fluid channels, and the ice pieces are transferred from a fresh food compartment of the refrigerator to an ice storage bucket located in a freezer compartment of the refrigerator. After a predetermined period of time or after a predetermined number of ice making cycles, fluid from within the fluid reservoir is drained and a fresh supply of fluid is added to the ice maker.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
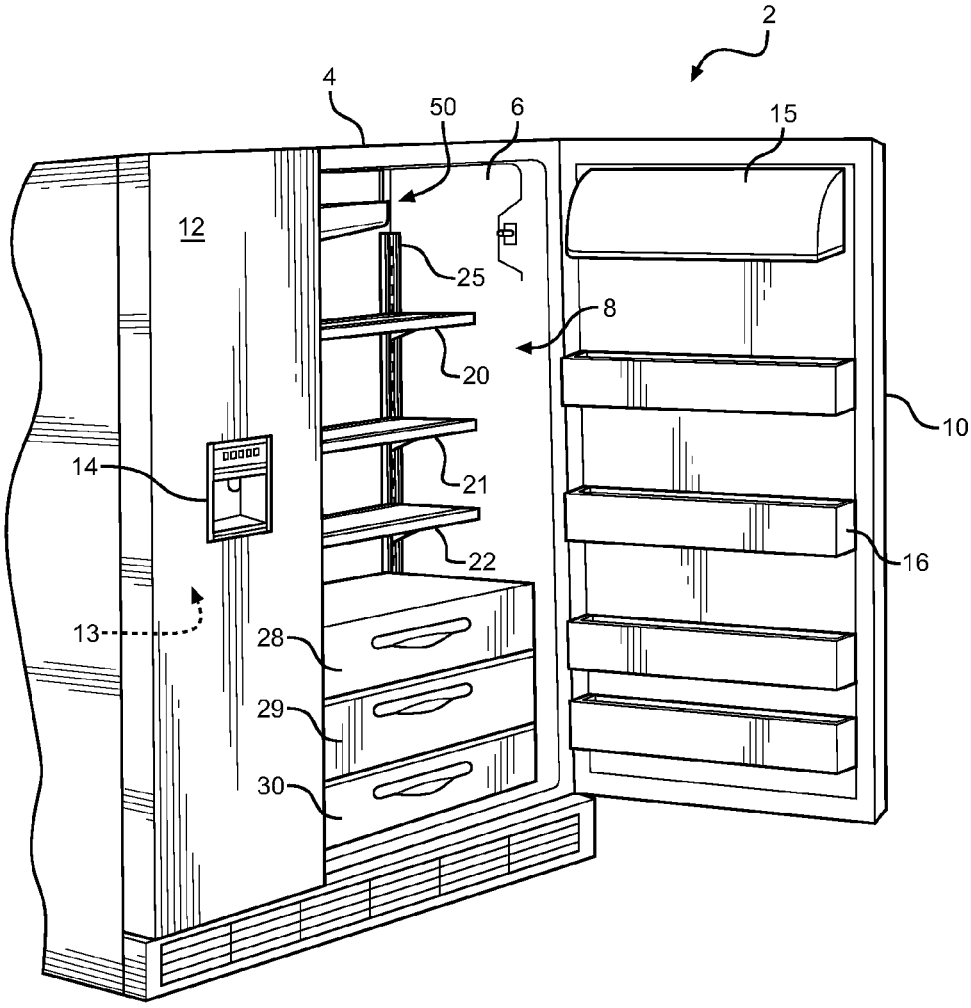
FIG. 1 is a perspective view of a refrigerator including an ice making assembly of the present invention.

With initial reference to FIG. 1, a refrigerator 2 includes an outer shell or cabinet 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment 13. In the embodiment shown, freezer door 12 includes a dispenser 14 that enables a consumer to retrieve ice and/or fresh water without accessing fresh food or freezer compartments 8 and 13. For the sake of completeness, door 10 of refrigerator 2 is shown to include a dairy compartment 15 and various vertically adjustable shelving units, one of which is indicated at 16.

In a manner known in the art, fresh food compartment 8 is provided with a plurality of vertically, height adjustable shelves 20-22 supported by a pair of shelf support rails, one of which is indicated at 25. At a lowermost portion of fresh food compartment 8 is illustrated various vertically spaced bins 28-30. At this point, it should be recognized that the above described refrigerator structure is known in the art and presented only for the sake of completeness. The present invention is not limited for use with a side-by-side style refrigerator shown, but may be utilized with other known refrigerator styles including top-mount or bottom-mount freezer styles. Instead, the present invention is particularly directed to a clear ice making assembly which is generally indicated at 50.

Figure 2:
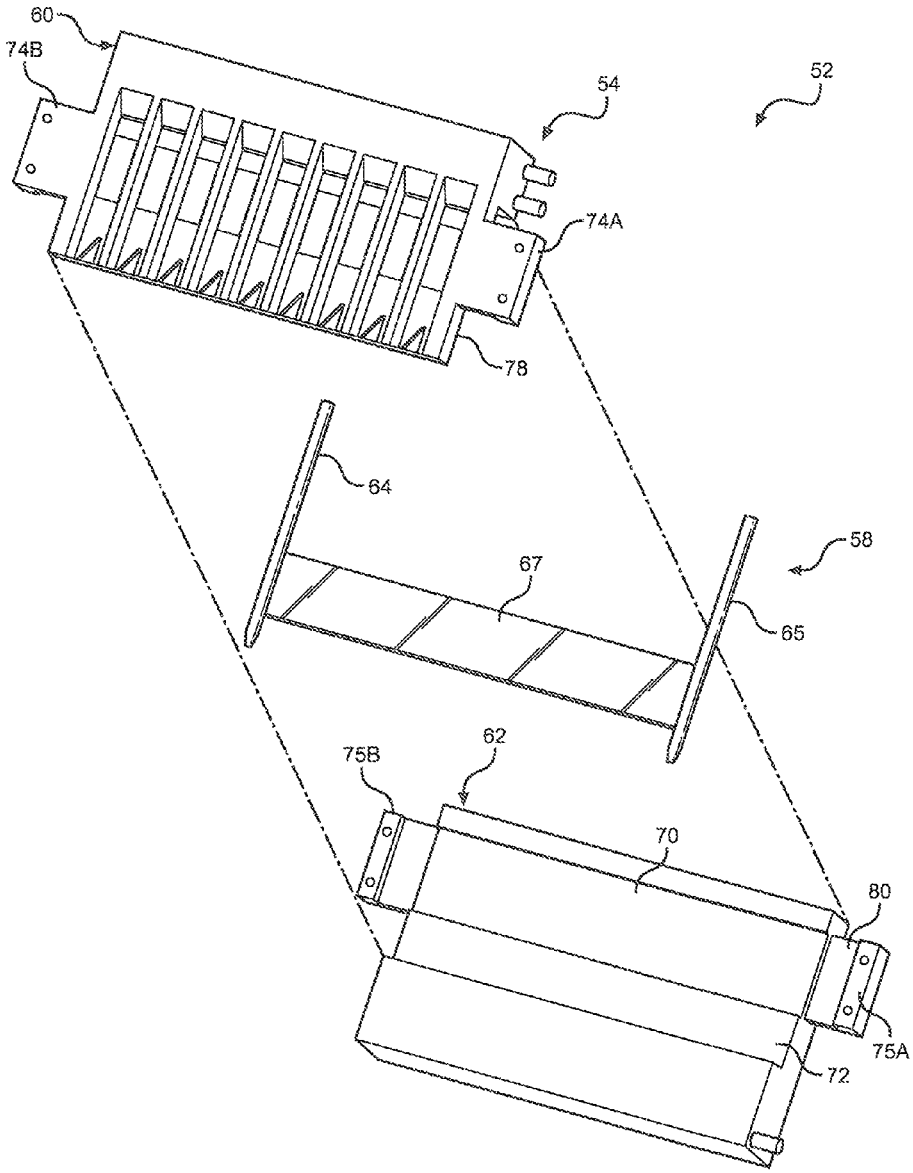
FIG. 2 is an exploded view of an ice making assembly of the present invention.

An ice maker 52 utilized in clear ice making assembly 50 will now be discussed with reference to FIG. 2. In general, ice maker 52 includes a housing 54 and an ice forming evaporator 58. In the preferred embodiment depicted, housing 54 includes a fluid channeling portion 60 and fluid recycling portion 62. Ice forming evaporator 58 includes a refrigerant inlet line 64 and a refrigerant outlet line 65 in fluid communication with a microchannel member 67. During assembly of ice maker 52, ice forming evaporator 58 is sandwiched between the fluid channeling portion 60 and fluid recycling portion 62. More specifically, microchannel member 67 fits within a receiving channel 70 formed in a front wall 72 of fluid recycling portion 62. Fluid channeling portion 60 and fluid recycling portion 62 snap-fit or otherwise connected together through opposing side flanges 74A, 74B and 75A, 75B extending from each of the fluid channeling and fluid recycling portions 60 and 62. When connected, housing 54 encloses microchannel portion 67 between front wall 72 of fluid recycling portion 62, and a back wall 78 of fluid channeling portion 60. The refrigerant inlet line 64 and refrigerant outlet line 65 are fit between channel forming portions 80 of respective side flanges 74A, 74B and 75A, 75B.

Additional details of ice maker 52 will now be discussed with reference to FIG. 3. Fluid channeling portion 60 defines spaced, distinct and substantially vertical fluid channels 84 separated by a plurality of divider walls 86. Each fluid channel 84 includes a back channel wall 90 having an ice-forming aperture region 92 created therein. In the preferred embodiment shown, each ice-forming region 92 constitutes an aperture which exposes a portion 93 (hereafter exposed portion 93) of microchannel member 67 to the fluid channel 84. It should be understood that microchannel member 67 directly abuts back channel wall 90 such that fluid introduced to fluid channel 84 does not leak through ice-forming aperture 92 into housing 54. An ice deflecting member 94 extends into each of the fluid channels 84 from a corresponding back channel wall 90. Fluid channeling portion 60 also includes front 94A, back 94B and opposing side walls 94C and 94D which define an upper fluid chamber indicated at 98 in fluid communication with each of fluid channels 84 through fluid inlet apertures 100 formed in each of fluid channels 84. Similarly, fluid recycling portion 62 includes front 102A, back 102B, bottom 102C and opposing side walls 102D, 102E which define a bottom fluid chamber 104 in communication with each of fluid channels 84 through fluid outlet apertures 106 defined by housing 54. A fluid inlet line 108 is in fluid communication with upper fluid chamber 98, and a fluid recycling line 109 is in communication with both the upper fluid chamber 98 and the bottom fluid chamber 104.

Various methods of initiating an ice making cycle are known in the art, including providing a controller for initiating an ice making cycle based on the amount of ice stored within an ice bucket. In accordance with the present invention, a known method of initiating an ice making cycle may be utilized, and such details are not considered to be part of the present invention. Instead, the invention is particularly directed to the structure of clear ice making assembly 50 and the manner in which ice pieces are produced and dispensed, which will now be discussed with reference to FIGS. 3 and 4. Upon initiation of an ice making event, water is continuously supplied to upper fluid chamber 98 via fluid inlet line 108. Water fills upper fluid chamber 98 and flows downward into respective fluid channels 84 through fluid inlet apertures 100 formed in housing 54. As shown, fluid inlet apertures 100 preferably take the form of narrow, elongated slots. Streams or sheets of water flow, preferably in a laminar fashion, vertically through each of the respective vertical fluid channels 84 and across exposed portion 93 of microchannel member 67, with any of the fluid which reaches fluid outlet apertures 106 draining into bottom fluid chamber 104. Fluid inlet apertures 100 are preferably centered above exposed portion 93 of microchannel member 67 such that fluid streams cascade over the entire face of exposed portion 93 before entering fluid recycling portion 62.

Figure 3:
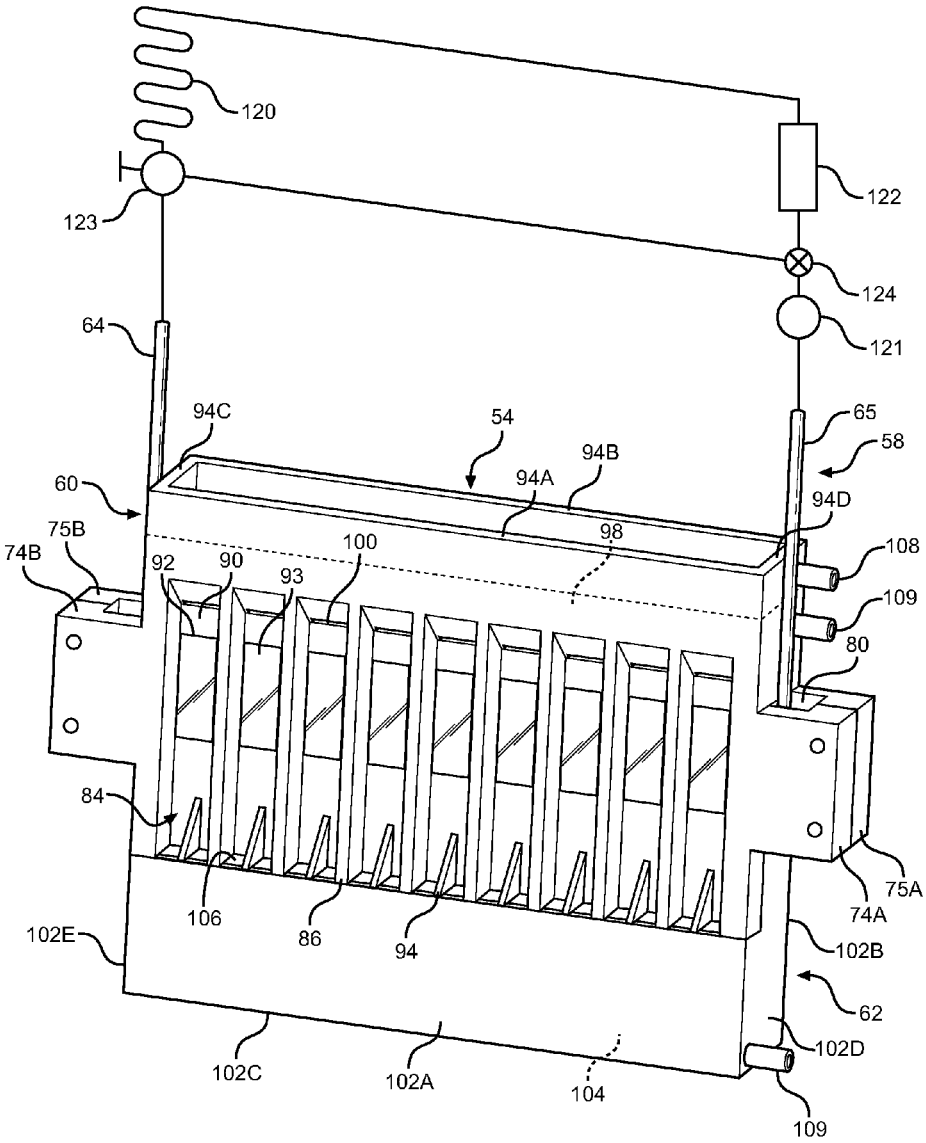
FIG. 3 is a perspective view of the ice maker of FIG. 2.

As depicted in FIG. 3, a refrigerant circulation system of refrigerator 2 is in fluid communication with ice forming evaporator 58. More specifically, cooled refrigerant from a refrigerator evaporator 120 flows into refrigerant inlet line 64 of ice forming evaporator 58 and through microchannel member 67 to refrigerant outlet line 65. Refrigerant then circulates through a compressor 121 and condenser 122 before circulating back through refrigerator evaporator 120 to start the cycle anew.

In accordance with the present invention, microchannel member 67 is chilled through direct contact with refrigerant. More specifically, with reference to FIG. 4, a plurality of longitudinally extending microchannels 130 distribute cooled refrigerant throughout microchannel member 67, thus cooling exposed portions 93 of the microchannel member 67. As indicated above, fluid streams flowing through vertical fluid channels 84 flow over chilled exposed portions 93, preferably in a laminar fashion, resulting in the formation of thin ice layers on the exposed portions 93, which build-up over time to form a clear ice piece. In the preferred embodiment shown, ice-forming apertures 92, and therefore exposed portions 93, are in the form of rectangles, however, ice-forming apertures 92 could take other shapes, such as ovals, depending on the shape of the ice pieces desired. Advantageously, the forming of thin ice layer upon layer prevents air bubbles from forming, and the constant flow of water "cleans" the ice pieces as they form, enabling the formation of clear ice pieces without air bubbles and cloudiness associated with the formation of standard ice pieces. In a preferred embodiment, ice forming evaporator 58 is formed from a material having high conductivity, such as copper, and housing 54 is formed from one or more plastic materials having a lower thermal conductivity than ice forming evaporator 58. Alternatively, or in addition, first and second fluid channeling portions 62 and 63 could be provided with a phobic or hydrophobic coating. With this configuration, ice only forms on exposed portions 93 during an ice production cycle, thereby forming clear and distinctly shaped individual ice pieces without any undesirable bridging between the ice pieces.

After a predetermined amount of time, or based on another known method for determining the end of an ice production cycle, microchannel member 67 is heated to melt the portions of the ice pieces in direct contact with exposed portions 93 in order to release the ice pieces from the ice maker 52. Heating of microchannel member 67 may be accomplished through the use of a heating element, such as an electric resistive heating element in heating relationship with microchannel member 67, or through the use of gaseous refrigerant, which is circulated through ice forming evaporator 58. Preferably, one or more valves indicated at 123 and 124 in FIG. 3 is/are actuated to direct heated refrigerant gas from compressor 121 through ice forming evaporator 58 in order to heat microchannel member 67 during an ice harvesting cycle. Such harvesting methods are known in the art and, therefore, will not be discussed in detail herein. See, for example, U.S. Pat. Nos. 5,212,957 and 7,587,905. In addition, other ice releasing arrangements could be employed, including the use of ice phobic technology, an electrical charge, a secondary heater and the like.

Figure 4:
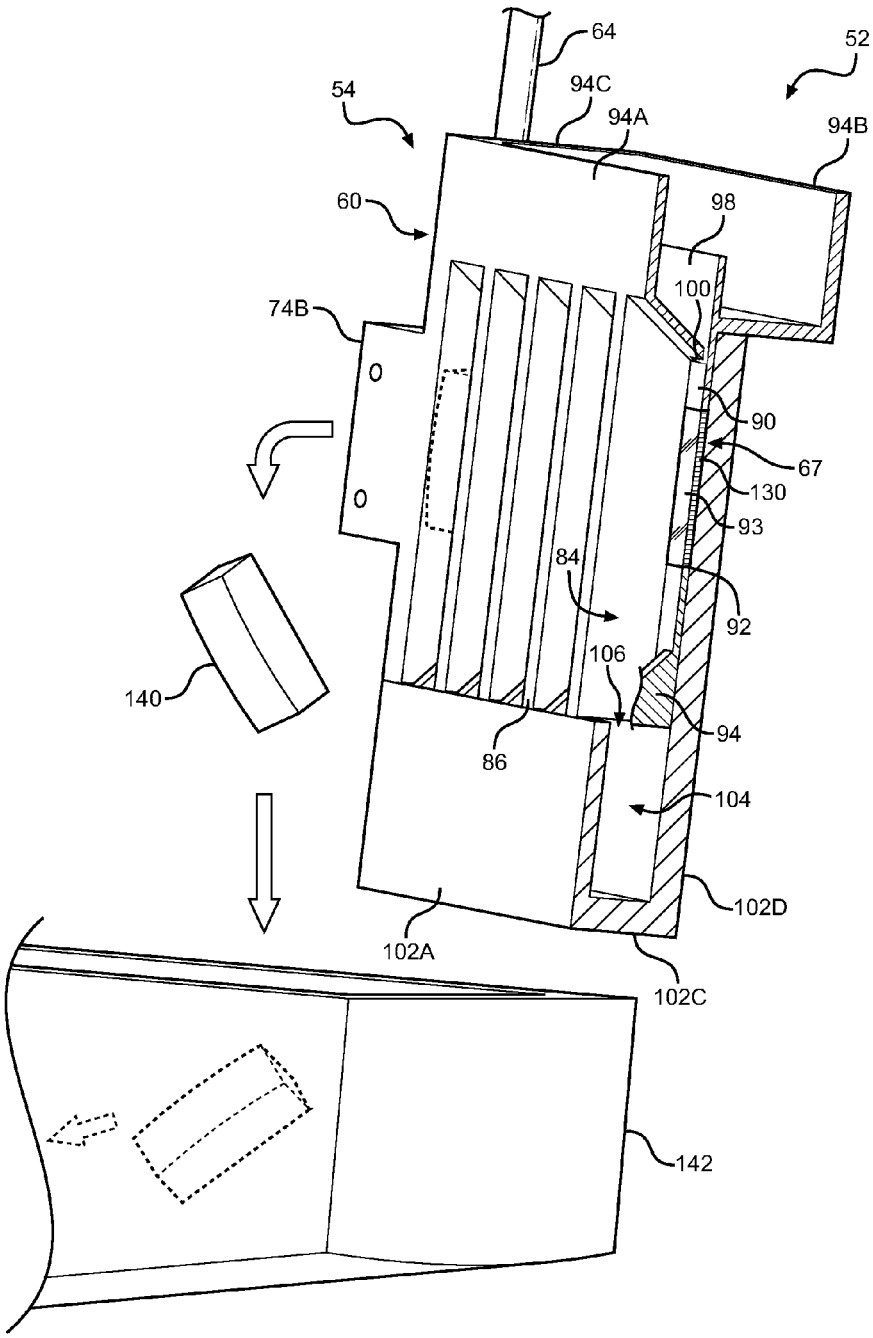
FIG. 4 is a partial cross-sectional side view of the ice maker of FIG. 2.
Figure 5:
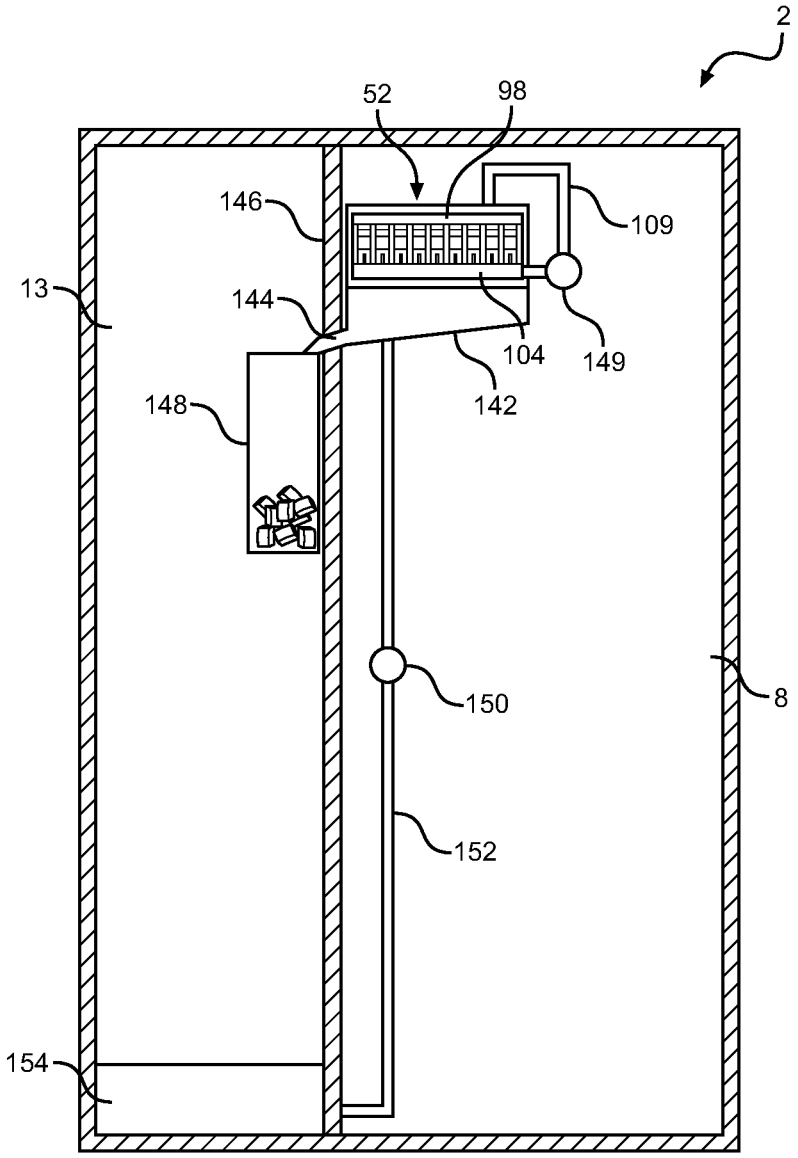
FIG. 5 depicts a fluid circulation system utilized in the present invention.

As depicted in FIG. 4, an ice piece 140 released from an exposed portion 93 will be guided by divider walls 86 and ice deflecting member 94 toward a storage container below. More specifically, in a preferred embodiment depicted in FIGS. 4 and 5, ice pieces 140 released from exposed portions 93 will be deflected by respective ice deflecting members 94 into an ice transfer chute 142, where the ice pieces 140 will be guided through an aperture 144 located in an insulated wall 146 separating the fresh food and freezer compartments 8 and 13, and into an ice storage bucket 148 located in the freezer compartment 13. During the ice forming event, water collected in bottom fluid supply channel 104 is preferably, continuously pumped by a pump 149 back into upper fluid chamber 98 via fluid recycling line 109. Alternatively, fresh water may be supplied to upper fluid chamber 98 for the duration of the ice forming event. At the beginning of a new ice forming event, water from bottom fluid supply channel 104, with or without additional fresh water, may be utilized to continuously supply water to upper fluid chamber 98. Preferably, water from bottom fluid supply channel 104 is recycled a predetermined number of times before a drain valve 150 is actuated, and bottom fluid supply channel 104 is emptied through a drain line 152 to a drain or condensate pan indicated at 154. Fresh fluid is then supplied to ice maker 52 through fluid inlet line 108 (shown in FIG. 3). The combination of upper fluid chamber 98, distinct fluid channels 84, and the fluid recycling method utilized, allows clear ice making assembly 50 to utilize minimal amounts of fluid in the production of ice pieces, preferably approximately 250 ml per ice-making cycle.

Based on the above, it can be seen that a multi-piece housing 54 fits together about an ice forming evaporator 58, and defines spaced, distinct, and substantially vertical fluid channels 84. An upper fluid chamber 98, also defined by housing 54, feeds fluid into each of the fluid channels 84, causing thin layers of ice to form on exposed portions 93 of the ice forming evaporator 58 and build up over time to form clear ice pieces having a desired size and shape. As discussed above, ice maker 52 includes its own dedicated ice forming evaporator 58 which is adapted to connect to the refrigerator circulation system of any type of refrigerator unit. With this modular configuration, ice maker 52 can be placed anywhere within a refrigerator. The result is an ice making system 50 that has wide range of applications and utilizes minimal amounts of fluid to form clear ice pieces, which are stored in a freezer compartment to prevent wasteful melting of the ice pieces over time.

Although described with reference to preferred embodiments of the invention, it should be readily understood that various changes and/or modifications can be made to the invention without departing from the spirit thereof. For instance, although shown in the form of slots defined by the two separate housing parts (i.e., fluid channeling portion 60 and fluid recycling portion 62), fluid outlet apertures 106 could be in the form of drain holes, or may be any other type of aperture allowing fluid to drain into bottom fluid supply channel 104. In addition, although multiple, horizontally arranged ice-forming apertures are shown, it should be understood that multiple, vertically arranged ice-forming apertures or regions could also be employed. Furthermore, although the preferred embodiment described forms the ice pieces directly on exposed portions of an ice forming evaporator that is part of the main refrigeration cooling system, other arrangement could be employed. For instance, a secondary coolant loop of a refrigerant recirculation system could be utilized to run coolant through the microchannels. Also, it is contemplated to utilize a Peltier arrangement wherein thermoelectric (TE) chips are positioned in the ice forming regions, with the ice pieces forming on a first or cold side of the TE chips and a second or hotter side of the TE chips being exposed to the microchannels such that the tubes defining the microchannels acting as heat sinks and the flow of refrigerant through the microchannels functioning to draw heat from the TE chips. Finally, although the invention has been described with reference to the depicted domestic refrigerator, the invention can also be employed in dedicated ice making machines, whether self-contained, under counter or countertop units. In general, the invention is only intended to be limited by the scope of the following claims.

What is claimed is:

1. A refrigerator comprising:

a cabinet including a fresh food compartment and a freezer compartment;

a refrigerant recirculation system; and a clear ice making assembly comprising:

an ice maker housing including a fluid channeling portion having an upper fluid chamber and a fluid recycling portion having a bottom fluid chamber, a plurality of spaced, substantially vertical fluid channels and a plurality of divider walls separating the fluid channels, with each of the plurality of fluid channels including a fluid inlet aperture in communication with the upper fluid chamber, a back wall exposed to the fluid inlet aperture and defining an ice-forming region, and a fluid outlet aperture in communication with the bottom fluid chamber;

a fluid inlet adapted to supply fluid to the upper fluid chamber; and a microchannel member sandwiched between the fluid channeling portion and the fluid recycling portion while abutting the back wall of each of the plurality of fluid channels, said microchannel member including a plurality of longitudinally extending microchannels in communication with the refrigerant recirculation system through inlet and outlet lines, the microchannel member being enclosed by said ice maker housing such that the microchannel member extends across each of the plurality of fluid channels, wherein the fluid from the upper fluid chamber flows through the fluid inlet aperture of each of the plurality of fluid channels, with a portion of the fluid being frozen at a respective said ice-forming region in creating a piece of ice, while a remainder of the fluid drains into the bottom fluid chamber through the fluid outlet aperture;

wherein the fluid channeling portion has a rear face, the fluid recycling portion has a front face and the microchannel member is located between the rear face of the fluid channeling portion and the front face of the fluid recycling portion, with the microchannel member abutting the back wall of each of the plurality of fluid channels.

2. The refrigerator of claim 1, wherein the ice maker housing is constructed of a material having a lower conductivity than a material of the microchannel member.

3. The refrigerator of claim 1, wherein the bottom fluid chamber is in fluid communication with the upper fluid chamber through a fluid recycling line; and the clear ice making assembly further comprises at least one pump controlling a transfer of fluid between the bottom fluid chamber and the upper fluid chamber.

4. The refrigerator of claim 1, wherein the clear ice making assembly further comprises a drain line adapted to drain fluid from the bottom fluid chamber.

5. The refrigerator of claim 1, wherein the fluid channeling portion also includes the plurality of divider walls.

6. The refrigerator of claim 1, wherein the clear ice making assembly further comprises:

an ice storage bucket located in the freezer compartment; and an ice transfer chute located beneath the plurality of fluid channels, wherein at least the plurality of fluid channels and the microchannel member are located in the fresh food compartment, and the ice transfer chute is adapted to transfer ice dispensed from the clear ice making assembly from the fresh food compartment to the freezer compartment.

7. The refrigerator of claim 1, wherein the ice maker housing further includes deflecting members extending into respective ones of the plurality of fluid channels such that ice pieces released from each of the plurality of fluid channels are guided by the plurality of divider walls and a respective deflecting member for storage within the refrigerator.

8. A clear ice making assembly comprising:

an ice maker housing including a fluid channeling portion having an upper fluid chamber and a fluid recycling portion having a bottom fluid chamber, a plurality of spaced, substantially vertical fluid channels and a plurality of divider walls separating the fluid channels, with each of the plurality of fluid channels including a fluid inlet aperture in communication with the upper fluid chamber, a back wall exposed to the fluid inlet aperture and defining an ice-forming region, and a fluid outlet aperture in communication with the bottom fluid chamber;

a fluid inlet adapted to supply fluid to the upper fluid chamber; and a microchannel member including a plurality of longitudinally extending microchannels adapted to be placed in communication with a refrigerant inlet and outlet lines, with the fluid channeling portion and a fluid recycling portion being fit together about the microchannel member wherein the microchannel member is enclosed by said ice maker housing such that the microchannel member extends across each of the plurality of fluid channels, wherein fluid is adapted to flow from the upper fluid chamber through the fluid inlet aperture of each of the plurality of fluid channels, with a portion of the fluid freezing at a respective said ice-forming region in creating a piece of ice, while a remainder of the fluid drains into the bottom fluid chamber through the fluid outlet aperture;

wherein the fluid channeling portion has a rear face, the fluid recycling portion has a front face and the microchannel member is located between the rear face of the fluid channeling portion and the front face of the fluid recycling portion, with the microchannel member abutting the back wall of each of the plurality of fluid channels.

9. The clear ice making assembly of claim 8, wherein the ice maker housing is constructed of a material having a lower conductivity than a material of the microchannel member.

10. The clear ice making assembly of claim 8, wherein the bottom fluid chamber is in fluid communication with the upper fluid chamber through a fluid recycling line; and the clear ice making assembly further comprises at least one pump controlling a transfer of fluid between the bottom fluid chamber and the upper fluid chamber.

11. The clear ice making assembly of claim 8, wherein the clear ice making assembly further comprises a drain line adapted to drain fluid from the bottom fluid chamber.

12. The clear ice making assembly of claim 8, further comprising:

an ice transfer chute located beneath the plurality of fluid channels and adapted to transfer ice dispensed from the clear ice making assembly to an ice storage bucket.

13. The clear ice making assembly of claim 8, wherein the ice maker housing further includes deflecting members extending into respective ones of the plurality of fluid channels such that ice pieces released from each of the plurality of fluid channels are guided by the plurality of divider walls and a respective deflecting member for storage.

14. A method of forming clear ice pieces with an ice making assembly including a housing having a fluid channeling portion with an upper fluid chamber and a fluid recycling portion with a bottom fluid chamber, a plurality of substantially vertical fluid channels and a plurality of divider walls that separate the fluid channels, the fluid channels establishing ice forming regions and being in fluid communication with both the upper fluid chamber and the bottom fluid chamber, the ice making assembly also including a microchannel member having a plurality of microchannels extending across the plurality of fluid channels, the microchannel member abutting a back wall of each of the plurality of fluid channels and being located between a rear face of the fluid channeling portion and a front face of the fluid recycling portion so that the microchannel member is sandwiched between the fluid channeling portion and the fluid recycling portion, the method comprising:

continuously supplying fluid from the upper fluid chamber through a plurality of fluid inlet apertures, each arranged at the back wall of a respective one of the plurality of fluid channels, into each of the plurality of substantially vertical fluid channels;

directing refrigerant through the microchannels;

freezing a portion of the fluid supplied from the upper fluid chamber of the fluid channeling portion of the housing, layer upon layer over a period of time, at the ice forming regions in the vertical fluid channels to form ice pieces; and draining a remainder of the fluid flowing from the upper fluid chamber and through the plurality of fluid channels into the bottom fluid chamber of the fluid recycling portion of the housing.

15. The method of claim 14, wherein the step of continuously supplying fluid from the upper fluid chamber includes pumping fluid from the bottom fluid chamber through a fluid recycling line to the upper fluid chamber.

16. The method of claim 14, further comprising the step of: draining fluid from the bottom fluid chamber.

17. The method of claim 14, wherein the flow into the plurality of fluid channels is laminar.

18. The method of claim 14, further comprising:

initiating an ice harvesting cycle including the steps of:

releasing the ice pieces from the ice making assembly housing; and transferring the released ice pieces to an ice storage bucket through an ice transfer chute.

19. The method of claim 18, wherein the ice making assembly housing and microchannel member are located within a fresh food compartment of a refrigerator and the ice storage bucket is located in a freezer compartment of the refrigerator, and the ice transfer chute transfers the ice pieces released from the ice making assembly housing through a wall separating the fresh food and freezer compartments to the ice storage bucket.

20. The clear ice making assembly of claim 8, wherein the microchannel member is located between the fluid channeling portion and the fluid recycling portion such that the microchannel member directly contacts both the fluid channeling portion and the fluid recycling portion.

21. The clear ice making assembly of claim 8, wherein the fluid channeling portion and the fluid recycling portion of the housing are snap-fit together to enclose the microchannel member therebetween.

* * * * *